US005641570A

United States Patent [19]

Blackwell

[11] Patent Number: 5,641,570

[45] Date of Patent: Jun. 24, 1997

[54] MULTICOMPONENT YARN VIA LIQUID INJECTION

[75] Inventor: Robert H. Blackwell, Candler, N.C.

[73] Assignee: BASF Corporation, Mt. Oiive, N.J.

[21] Appl. No.: 561,501

[22] Filed: Nov. 20, 1995

[51] Int. Cl.[6] ..... D02G 3/00

[52] U.S. Cl. ..... 428/370; 428/373; 428/374

[58] Field of Search ..... 428/370, 373, 428/374; 524/270

[56] References Cited

U.S. PATENT DOCUMENTS

| | | | |
|---|---|---|---|
| 3,616,149 | 10/1971 | Wincklhofer et al. | 428/373 |
| 3,700,544 | 10/1972 | Matsui | 428/373 |
| 3,803,453 | 4/1974 | Hull | 317/2 R |
| 3,975,351 | 8/1976 | Etchells | 428/373 |
| 4,185,137 | 1/1980 | Kinkel | 428/372 |
| 4,285,748 | 8/1981 | Booker et al. | 156/167 |
| 5,019,445 | 5/1991 | Sternlieb | 428/323 |
| 5,157,067 | 10/1992 | Burditt et al. | 524/270 |
| 5,162,074 | 11/1992 | Hills | 156/644 |
| 5,236,645 | 8/1993 | Jones | 264/78 |
| 5,308,395 | 5/1994 | Burditt et al. | 106/500 |
| 5,318,845 | 6/1994 | Tanaka et al. | 428/373 |
| 5,364,582 | 11/1994 | Lilly | 264/211 |
| 5,405,698 | 4/1995 | Dugan | 428/374 |

*Primary Examiner*—Newton Edwards

[57] ABSTRACT

A process for producing multicomponent fibers provides a dispersion of a particulate additive or chemical compound in a nonaqueous liquid carrier, forms a blend of a first thermoplastic polymer and the dispersion by injecting the dispersion into an extruder which is part of a fiber extrusion apparatus and which extruder is extruding the tint thermoplastic polymer thereby forming a blend of the additive in the first thermoplastic polymer, provides a second thermoplastic polymer to the fiber extrusion apparatus; in the fiber extrusion apparatus, arranges the blend and the second thermoplastic polymer in a preselected, mutually separated relative arrangement; directs the arrangement of blend and the second thermoplastic polymer to a spinneret which is a part of the fiber extrusion apparatus while maintaining the preselected, mutually separated relative arrangement; exudes the directed arrangement of the blend and the second molten polymer through the spinneret to form multicomponent fibers; and solidifies the multicomponent fibers.

4 Claims, No Drawings

MULTICOMPONENT YARN VIA LIQUID INJECTION

FIELD OF THE INVENTION

This invention relates generally to the field of thermoplastic multicomponent fibers and processes for making them. More particularly, this invention relates to multicomponent fibers having additives in one or more of the components and processes for making such fibers.

BACKGROUND OF THE INVENTION

As used in this specification, the following terms have the meanings ascribed to them below.

"Fiber" or "fibers" means the basic element of fabric or other textile structures which is characterized by a length at least 100 times its diameter or width and made from a synthetic polymer matrix. The term "fiber" encompasses short length fibers (i.e., staple fibers) and fibers of indefinite length (i.e., continuous filaments).

"Multicomponent fiber" or "Multicomponent fibers" means fibers having at least two longitudinally co-extensive domains or components. These domains (or components) may differ in the identity of the polymer matrix, or in the type or amount of additives present in each domain, or in both the identity of the matrix and the additive level or identity.

"Bicomponent fiber" or "bicomponent fibers" means a multicomponent fiber having only two different longitudinally coextensive domains.

"Sheath/core fiber" or "sheath/core fibers" means multicomponent fibers having one or more outer domains that substantially surround at least one or more inward domain. An outer domain that substantially surrounds an inward domain abuts more than 50% of the inner domain's periphery.

"Nonaqueous liquid" means a material which is substantially free from water and is in the liquid state at conditions commonly found in buildings and other environments occupied by humans typically 50°–110° F.

Multicomponent fibers are known. Multicomponent fibers may be classified into one of at least three major classes. One class includes multicomponent fibers with the components differing from each other in the type of polymer matrix forming each component. Such fibers are described in, for example. U.S. Pat. No. 4,285,748 to Booker et al.

Another class of multicomponent fibers includes those with components differing in the level or type of additive in the components but where the matrix polymers are predominately the same or similar. An example of this type of multicomponent fiber is described in U.S. Pat. No. 5,019,445 to Sternlieb.

A further category of multicomponent fibers includes fibers with components differing in both the polymeric matrix material and the relative amount of additives or types of additives in each component. Examples of such multicomponent fibers are described in U.S. Pat. No. 3,803,453 to Hull; U.S. Pat. No. 4,185,137 to Kinkel; and U.S. Pat. No. 5,318,845 to Tanaka.

In certain circumstances during the manufacture of multicomponent fibers, significant concern is given to whether or not such fibers rill separate at the interface between components. One reason multicomponent fibers separate is due to the incompatibility of the components. Sometimes, it is desirable that the components separate at the interface between them. For example, the incompatibility principle can be used to make microfibers by fibrillating multicomponent fibers along the component interface thereby resulting in fibers of decreased size. To make such microfibers, therefore, the incompatibility of the components might be intentionally maximized.

In other circumstances, however, it is undesirable for the components to separate from each other. For these cases, care must be taken in selecting matrix polymers and additives to assure sufficient compatibility or, rather, to prevent so much incompatibility that the fibers delaminate when subjected to post-spinning stress, e.g., bending around a godet.

Methods for adding additives to fibers are known. For example, U.S. Pat. No. 5,308,395 to Burditt describes a liquid carrier for incorporation into polymeric resins. This patent describes the use of such carriers to make fibers but does not address multicomponent fibers.

Also, U.S. Pat. No. 5,364,582 to Lilly describes the use of a certain carrier to add polyoxyethylene alkylamine antistatic agents to monocomponent fibers. The carders may be an organic resin based composition containing surfactant and diluent.

Moreover, the ability to add additives directly to a fiber extrusion line without the necessity of storing and metering extremely dry additive-containing chip provides significant process and economic advantages. U.S. Pat. No. 5,236,645 to Jones describes an aqueous based system for adding additives directly to a fiber extrusion process. The aqueous portion is removed through a vent in the extruder so that water is not significantly present in the extruder output. However, the addition of aqueous mixes to polymer melts may sometimes significantly reduce the relative or intrinsic viscosity of the polymer. This is true, for example, with nylon 6 and, to a larger extent, with polyester. The loss in viscosity has a significant effect on yarn physical properties and the ability to successfully spin fibers.

Therefore, there remains a need for methods to add additives inline during the fiber extrusion process without requiring removal of water and without leading to incompatibility problems resulting in delamination at the interface between components.

SUMMARY OF THE INVENTION

Accordingly, one embodiment of the present invention is a process for producing multicomponent fibers. The process comprises providing a dispersion of a particulate additive or chemical compound in a nonaqueous liquid carrier, forming a blend of a first thermoplastic polymer and the dispersion by injecting the dispersion into an extruder which is part of a fiber extrusion apparatus and which extruder is extruding the first thermoplastic polymer thereby forming a blend of the additive in the first thermoplastic polymer, providing a second thermoplastic polymer to the fiber extrusion apparatus; in the fiber extrusion apparatus, aging the blend and the second thermoplastic polymer in a preselected, mutually separated relative arrangement; directing the arrangement of the blend and the second thermoplastic polymer to a spinneret which is a part of the fiber extrusion apparatus while maintaining the preselected, mutually separated relative arrangement; extruding the directed arrangement of the blend and the second molten polymer through the spinneret to form multicomponent fibers; and solidifying the multicomponent fibers.

Another embodiment of the present invention is a multicomponent fiber comprising a first longitudinally extensive domain formed from a blend of a first thermoplastic polymer with a particulate additive dispersed in a nonaqueous carrier;, and a second longitudinally extensive domain of a second thermoplastic polymer arranged coextensively with the first longitudinally extensive domain and a forming an outer domain that substantially surrounds the first longitudinally extensive domain.

It is an object of the present invention to provide a process for adding additives in nonaqueous carriers directly to a multicomponent fiber extrusion line without causing incompatibility associated problems between the components of the fiber.

DETAILED DESCRIPTION OF THE PREFERRED EMBODIMENTS

To promote an understanding of the principles of the present invention, descriptions of specific embodiments of the invention follow and specific language describes the same. It will nevertheless be understood that no limitation of the scope of the invention is thereby intended, and that such alterations and further modifications, and such further applications of the principles of the invention as discussed are contemplated as would normally occur to one ordinarily skilled in the an to which the invention pertains.

One embodiment of the present invention concerns a process for producing multicomponent fibers. In this process, a dispersion of a particulate additive in a nonaqueous liquid carrier is provided. This dispersion is injected into an extruder. The extruder is part of an entire fiber extrusion system, i.e., apparatus. The extruder is extruding a tint thermoplastic polymer and, after injection of the dispersion into the extruder, a blend of the first thermoplastic polymer with dispersion is formed.

A second thermoplastic polymer is also provided to the fiber extrusion apparatus and, in the apparatus, arranged with the blend in a preselected, mutually separated relative arrangement. This arrangement is directed to a spinneret (also part of the fiber extrusion apparatus) and extruded into multicomponent fibers which are then solidified. The fiber so formed may be subsequently processed according to conventional downstream processes depending on the intended use (e.g., carpet fiber processes for carpet fibers). Surprisingly, the presence of the nonaqueous liquid carrier does not cause incompatibility problems during such subsequent processing of the multicomponent fiber and even in the ultimate end use.

Preferred additives for incorporation into multicomponent fibers according to the present invention include a variety of particulate additives such as pigments, $TiO_2$, light stabilizers, heat stabilizers, flame retardants, antistatic compounds, antibacterial compounds, antistain compounds, pharmaceuticals and carbon black.

The nonaqueous liquid carrier can be any nonaqueous liquid carrier that is compatible with the polymers being extruded. Preferred carriers are based upon or derived from gum, wood and/or tall oil resin which are mainly of the fused-ring moncarboxylic acids. These preferred nonaqueous liquid carriers are described in U.S. Pat. No. 5,308,395 to Burditt et al., the specification of which is hereby incorporated by reference.

The thermoplastic polymer which is blended with the additive/carrier system may be any one of a wide variety of fiber-forming polymeric materials. For example, this thermoplastic polymer may be selected from the polyamides, polyesters, polyacrylics, polyethers, polycaprolactones and polyolefins.

The second thermoplastic polymer may also be selected from the wide variety of fiber-forming polymers. These polymers include polyamides, polyesters, polyacrylics, polyethers, polycaprolactones and polyolefins.

The particulate additive may be dispersed in the nonaqueous liquid carrier by known mixing techniques. Exemplary techniques for mixing are described in Burditt, incorporated by reference above. The concentration of additives in the dispersion will depend on the particular additive, the spinning conditions and the desired concentration of additive in the fiber end product. For example, in the case of carbon black, additive mixtures containing up to about 40 wt % of carbon black in an organic resin-based carrier have been used. Higher and lower loadings are envisioned.

The injection of the dispersion may be accomplished according to known techniques. To illustrate, conventional fiber spinning equipment may be equipped with an injection port that can be in one or more areas: 1) injection port (for a tube or nozzle-typically made of stainless steel) at the extruder feed throat can be through the throat housing or the tube may be extended through the polymer chip feed port to a point just above the extruder screw flight or flights; 2) an injection port area along the extruder barrel allows for injection prior to a mixing area; or 3) an injection port area along the polymer distribution line prior to a mixing device such as an inline static mixer commonly used in the trade.

The injection port is equipped with a tube or nozzle that is plumbed to the outlet of a pump that has a very highly accurate rate of delivery. The pumps can be gear, piston, etc., as supplied by a host of vendors such as, Barmag, Zenith, and Feinpruef. They are linked mechanically or preferably electronically to the extruder such that the injection pump output automatically follows the polymer throughput to keep the addition rate constant. The injection pump feed is connected to a vessel that is a reservoir for the additive.

The fibers may be spun according to conventional multicomponent spinning equipment with appropriate considerations for the differing properties of the two components. One such exemplary spinning method is described in U.S. Pat. No. 5,162,074 to Hills. The patent is incorporated by reference for the spinning techniques described therein.

The fibers of the present invention can be made in a wide variety of deniers per filament (dpf). It is not currently believed that there are any limitations on denier and the desired denier depends upon the end use.

Another embodiment of the present invention is a multicomponent fiber having a first longitudinally extensive domain formed from a blend of a first thermoplastic with a particulate additive dispersed in a nonaqueous carrier and a second longitudinally extensive domain of a second thermoplastic polymer arranged coextensively with the first longitudinally extensive domain. Especially preferred arrangements of the domains are such that the second polymer forms an outer domain that substantially surrounds the first longitudinally extensive domain.

These fibers produced by the present invention may be round or nonround, eccentric or concentric sheath/core configurations, side-by-side, islands-in-the sea or any other multicomponent fiber configuration and combinations of these. Multicomponent fibers of this embodiment may be made with the materials and processes described above.

This invention will now be described by reference to the following detailed examples. The examples are set forth by way of illustration, and are not intended to limit the scope of the invention. In the following examples, the listed factors are measured as follows:

Change in Pressure

Measurement of polymer pressure in the polymer distribution system can be monitored at any given moment, or the pressure can be recorded over a period of time to calculate the amount of change. The pressure is measured using pressure transducers in contact with the molten polymer and the resulting signal converted to a digital readout using a distributive control system (DCS) such as systems available from Foxboro Company.

Polymer Throughput

Polymer throughput is the weight (in grams) of polymer pumped through the spinneret (or one hole of the spinneret depending on which value is desired) for a given period of time (usually in one minute). The throughput is measured by weighing the polymer extruded for a given time and calculating the weight in grams per minute.

Filtration Factor (also referred to as a Pressure Rise Index Test)

This factor is the pressure rise per gram of additive measures pressure rise based on the grams of additive (pigment only) being pumped through the spin pack consisting of a filtration medium and spinneret. In the following examples the filtration medium is a series of plates stacked from top to bottom. (relative to polymeric flow) as follows:

35 mm screen (165×1420)
35 mm breaker plate 10 mm thick
12 hole spinneret (250 μ holes)

Pressure is set at 2000 psi initially and pressure measurements are made at intervals.

| | |
|---|---|
| Polyester intrinsic viscosity: | Goodyear Tire and Rubber Company Method R100 |
| Dry heat shrinkage | ASTM D2259-87 |
| Boiling water shrinkage | ASTM D2259-87 (modified to eliminate surfactants in boiling water) |

The following examples are set forth as illustrative of the present invention, to enable one skilled the art to practice the invention. These examples are not to be read as limiting the invention as defined by the claims set forth herein.

EXAMPLE 1

(The Invention)

A liquid dispersion containing 40% by weight of carbon black is prepared by adding 40 grams of carbon black to 60 grams of a vehicle as described in U.S. Pat. No. 5,308,395. This dispersion is evaluated and produces the following results:

| | |
|---|---|
| Change in Pressure (psi) | 890 |
| Polymer Throughput (g/min) | 32.08 |
| Evaluation time (min) | 240 |
| Filtration Factor | 38 |

A fiber melt spinning system is spinning sheath/core bicomponent fibers from poly(ethylene terephthalate) ("PET") (0.640 IV measured in 60/40 phenol/1,1,2,2, tetrachloroethane) and polycaprolactam (nylon 6) (2.80 RV measured in 90% formic add). The poly(ethylene terephthalate) forms the core and the nylon 6 forms the sheath. The core makes up 77 wt % of the fiber. The liquid dispersion of carbon black is added at the extruder throat via an injection gear pump. The addition rate is adjusted to provide 0.03% weight of carbon black in the PET core polymer. No fluctuations are noted in extruder screw speed, or pressure.

The bicomponent fiber is wound up at 3500 m/min using conventional equipment. The physical properties of this yarn are measured and reported in Table 1.

The yarn is melt bonded to give a nonwoven having a weight of 175 gms/m$^2$ and several properties are evaluated. Table 11 shows these properties.

EXAMPLE 2

(Comparative Example)

(Yarn from Concentrate Chip)

Polymer chips containing about 0.6% carbon black in PET are metered to the polymer chip stream such that the extruded polymer contains 0.03 % carbon black. The crystalized chips (with and without carbon black) have an intrinsic viscosity of 0.640.

A fiber melt spinning system is spinning sheath/core bicomponent fibers from the PET with 0.03% carbon black and nylon 6. The PET forms the core and the nylon 6 forms the sheath. This bicomponent fiber is wound up into a 110 filament yarn. The physical properties of this yarn are measured and reported in Table I.

The yarn is melt bonded to give a nonwoven fabric having a weight of 175 gm/m$^2$ and several properties are evaluated. Table 11 shows these nonwoven properties.

TABLE I

| Yarn Property | Example 1 (invention) | Example 2 (comparative) |
|---|---|---|
| Intrinsic Viscosity | 0.584 | 0.604 |
| DL after Crocking | 1.98 | 1.66 |
| DTEX | 1651 | 1654 |
| Load at 10% Elongation (N) | 27.0 | 27.8 |
| Load at 20% Elongation (N) | 35.4 | 36.8 |
| Load at 45% Elongation (N) | 49.2 | 57.7 |
| Load at Break (N) | 51.6 | 58.2 |
| Elongation at 20N | 4.1 | 3.9 |
| Elongation at Break (%) | 49.8 | 60.2 |
| Boiling Water Shrinkage (%) | 3.9 | 2.8 |
| Dry Heat Shrinkage (%) | 9.1 | 7.9 |
| Density | 1.327 | 1.328 |
| DSC Melt (°C.) | 220/250 | 220/250 |
| Cool (°C.) | 175/195 | 175/197 |
| Remelt (°C.) | 211/253 | 209/253 |
| TGA % Weight Loss 28–320° C. | 1.24 | 1.80 |
| TGA % Weight Loss (ISO) at 210° C. 15 min | 0.41 | 0.39 |

Table I shows the yarn properties of each bicomponent yarn Thermogravimetric analysis did not indicate that the nonaqueous liquid carrier off gassed at spinning temperatures. Lack of off-gassing supports that the carrier does not cause or tend to cause delamination of the components. Thermogravimetric analysis shows no significant differences in volatiles between the comparative yarn and yarn made according to the invention.

TABLE II

| Nonwoven Fabric Property | Example 1 (invention) | Example 2 (comparative) |
|---|---|---|
| TGA % Weight Loss 28–315° C. | 0.8 | 0.9 |
| DSC Melt Peak (°C.) | 217/250 | 217/254 |
| DSC Remelt Peak (°C.) | 217/252 | 217/252 |
| TGA % Weight Loss (ISO) @ 215° C. 15 min | 0.3 | 0.3 |
| Trapezoid Tear MD (N) | 338 | 364 |

TABLE II-continued

| Nonwoven Fabric Property | Example 1 (invention) | Example 2 (comparative) |
|---|---|---|
| Trapezoid Tear XMD (N) | 311 | 313 |
| Load at Break MD (2 × 8 inch) N/M | 13544 | 13701 |
| Load at Break XMD (N/M) | 11300 | 11733 |
| Elongation at Break MD (%) | 32 | 34 |
| Elongation at Break XMD (%) | 30 | 34 |
| Mass ($G/M^2$) | 180 | 178 |
| Puncture (N) | 339 | 341 |
| Nonwoven Fabric Shrinkage MD (%) | 1.083 | 1.273 |
| Nonwoven Fabric Shrinkage XMD (%) | 1.187 | 1.205 |

What is claimed is:

1. A multicomponent fiber comprising:

a first continuous longitudinally extensive domain formed from a blend of a first thermoplastic polymer with a particulate additive dispersed in a liquid organic rosin carrier; and a second continuous longitudinally extensive domain consisting essentially of a second thermoplastic polymer which is arranged coextensively with said first longitudinally extensive domain and forms an outer domain that substantially surrounds the first longitudinally extensive domain.

2. The multicomponent fiber of claim 1 wherein said first thermoplastic polymer is selected from the group consisting of:

polycaprolactone;

polyamides;

polyesters;

polyacrylics;

polyethers; and polyolefins.

3. The multicomponent fiber of claim 1 wherein said second thermoplastic polymer is selected form the group consisting of:

polycaprolactone;

polyamides;

polyesters;

polyacrylics;

polyethers; and polyolefins.

4. The multicomponent fiber of claim 1 wherein said fiber is a sheath/core fiber;

said first domain is a blend of (a) poly(ethylene terephthalate) with (b) carbon black dispersed in a nonaqueous liquid carrier which is based on or derived from gum, wood or tall oil resin of mainly fused ring monocarboxylic acid; and said second domain is polycaprolactam, said polycaprolactam forming the sheath and said blend forming the core of said sheath/core fiber.

* * * * *

UNITED STATES PATENT AND TRADEMARK OFFICE

CERTIFICATE OF CORRECTION

PATENT NO. : 5,641,570

DATED : June 24, 1997

INVENTOR(S) : Robert H. Blackwell

It is certified that error appears in the above-indentified patent and that said Letters Patent is hereby corrected as shown below:

At column 2, line 55, please delete "aging" after "apparatus," and replace it with --arranging--.

At column 3, line 2, please delete the comma (",") after the semicolon (";").

At column 3, line 28, please delete "tint" after "a" and replace it with --first--.

Signed and Sealed this

Twenty-fifth Day of November, 1997

*Attest:*

*Attesting Officer*

BRUCE LEHMAN

*Commissioner of Patents and Trademarks*